US010034513B2

(12) United States Patent
Donaldson

(10) Patent No.: US 10,034,513 B2
(45) Date of Patent: Jul. 31, 2018

(54) FOOTWEAR / SHOES

(76) Inventor: Ben Aaron Donaldson, Merewether (AU)

( * ) Notice: Subject to any disclaimer, the term of this patent is extended or adjusted under 35 U.S.C. 154(b) by 2106 days.

(21) Appl. No.: 14/392,049

(22) PCT Filed: Aug. 13, 2009

(86) PCT No.: PCT/AU2009/001039
§ 371 (c)(1),
(2), (4) Date: Aug. 7, 2015

(87) PCT Pub. No.: WO2010/017592
PCT Pub. Date: Feb. 18, 2010

(65) Prior Publication Data

US 2016/0198791 A1 Jul. 14, 2016

(30) Foreign Application Priority Data

Aug. 13, 2008 (AU) ..... 2008904131

(51) Int. Cl.

| | |
|---|---|
| ***A43B 13/22*** | (2006.01) |
| ***A43B 13/24*** | (2006.01) |
| ***A43B 13/12*** | (2006.01) |
| ***A43B 1/00*** | (2006.01) |
| ***A43B 13/10*** | (2006.01) |

(52) U.S. Cl.
CPC ..... *A43B 13/125* (2013.01); *A43B 1/0054* (2013.01); *A43B 13/10* (2013.01); *A43B 13/24* (2013.01)

(58) Field of Classification Search
CPC ..... A43B 1/0054; A43B 13/125; A43B 13/24
See application file for complete search history.

(56) References Cited

U.S. PATENT DOCUMENTS

| | | | | |
|---|---|---|---|---|
| 5,473,963 | A * | 12/1995 | Aeschbach | A43B 1/0054 36/131 |
| 5,704,256 | A * | 1/1998 | De Lattre | A43B 1/0054 36/131 |
| 5,769,438 | A * | 6/1998 | Svetlov | A63C 17/01 280/87.041 |
| 6,405,456 | B1 * | 6/2002 | Nichelson | A43B 1/0054 36/27 |
| 7,837,218 | B2 * | 11/2010 | Flaig | A63C 9/0802 280/14.22 |

(Continued)

FOREIGN PATENT DOCUMENTS

| | | | |
|---|---|---|---|
| CN | 2745393 | Y | 12/2005 |
| KR | 10 20080016919 | A1 | 2/2008 |

(Continued)

OTHER PUBLICATIONS

International Search Report dated Sep. 7, 2009 from International Patent Application No. PCT/AU2009/001039, filed Aug. 13, 2009.

(Continued)

*Primary Examiner* — Joshua E Rodden
(74) *Attorney, Agent, or Firm* — Sunstone IP

(57) ABSTRACT

Footwear (1) having a vamp (2), an insole, a midsole (3) and an outsole (4). A plurality of spaced apart magnets (5) located adjacent the outsole (4) so that in use the magnets (5) provide a gripping force between the footwear (1) and a metallic surface upon which the footwear (1) is placed.

10 Claims, 2 Drawing Sheets

(56) References Cited

U.S. PATENT DOCUMENTS

| | | | | |
|---|---|---|---|---|
| 8,371,046 | B2 * | 2/2013 | Yanke | A43B 1/0054 36/114 |
| 2003/0075890 | A1 * | 4/2003 | Jacobs | A63C 10/02 280/87.042 |
| 2003/0211789 | A1 * | 11/2003 | Taylor | B63B 35/7936 441/74 |
| 2008/0172909 | A1 * | 7/2008 | Banks | A43B 1/0054 36/136 |
| 2009/0288316 | A1 * | 11/2009 | Fullerton | A43B 1/0054 36/116 |
| 2010/0175353 | A1 * | 7/2010 | Der | A43B 1/0054 54/49 |
| 2010/0237599 | A1 * | 9/2010 | Bianchi | A43B 1/0054 280/841 |
| 2011/0219911 | A1 * | 9/2011 | Zoumaras | B62J 25/00 74/594.6 |
| 2011/0302811 | A1 * | 12/2011 | Chang | A43B 1/0054 36/131 |

FOREIGN PATENT DOCUMENTS

| | | | |
|---|---|---|---|
| SU | 1743554 | A1 | 6/1992 |
| WO | 2008018733 | A1 | 2/2008 |

OTHER PUBLICATIONS

International Preliminary Report on Patentability dated Feb. 15, 2011 from International Patent Application No. PCT/AU2009/001039, filed Aug. 13, 2009.

Exam Report dated Sep. 8, 2016 from Australian Patent Application No. 2009281707, filed Aug. 13, 2009.

Exam Report dated Mar. 1, 2017 from Australian Patent Application No. 2009281707, filed Aug. 13, 2009.

* cited by examiner

FOOTWEAR / SHOES

FIELD OF THE INVENTION

The present invention relates to footwear and, in particular to, a shoe having magnets located in the sole for attachment to a metal surface.

BACKGROUND OF THE INVENTION

Footwear of all types are well known and commonly used throughout the world. Typical footwear includes a vamp or upper that holds the shoe onto the foot of a user and a sole which cushions the impact of a user on a surface. The sole includes an insole which is the interior bottom of a shoe which contacts the user's foot in use and an outsole which is in direct contact with a surface. The midsole is the layer between the insole and the outsole and typically includes shock absorbent material or the like.

Footwear designed specially for a work environment has increased greatly and now includes features such as a steel cap front portion and/or the vamp being oil, heat or grease resistant, for example.

Further, there are many different types of outsoles. For example, hiking boots have a very pronounced grip tread, shoes for ice and rain have been developed and athletic shoes have ranges of outsoles for particular sports.

In the construction industry, many workers climb on scaffolding, structures, rooves or the like and require substantial dexterity not to fall. Many of the roof surfaces can be slippery with little grip being provided. Safety harnesses and barriers have been developed to prevent a workman falling. No consideration has been given to the workman's shoes.

Accordingly, there is a need for footwear that provides a user increased gripability to a work surface such as a roof and in particular to a roof made of metallic materials.

OBJECT OF THE INVENTION

It is an object of the present invention to substantially overcome or at least ameliorate one or more of the disadvantages of the prior art, or to at least provide a useful alternative.

SUMMARY OF THE INVENTION

There is firstly disclosed herein footwear having:

a vamp;

an insole;

a midsole; and an outsole;

a plurality of spaced apart magnets located adjacent said outsole so that in use said magnets provide a gripping force between said footwear and a metallic surface upon which said footwear is placed.

Preferably, said magnets are embedded in said midsole.

Preferably, said midsole includes a first surface adjacent said insole and a second surface adjacent said outsole, and a plurality of apertures to receive said magnets extending inwardly from said second surface towards said first surface.

Preferably, said magnets are located 2 to 10 mm from the second surface.

Preferably, said magnets are located 2 to 4 mm from the second surface.

Preferably, said magnets are equally spaced apart along a longitudinal length of said footwear.

Preferably, said magnets are aligned in a series of spaced apart rows along a longitudinal length of said footwear.

Preferably, a distance between adjacent rows is 10 to 15 mm.

BRIEF DESCRIPTION OF THE DRAWINGS

A preferred embodiment of the present invention will now be described, by way of an example only, with reference to the accompanying drawings wherein.

DETAILED DESCRIPTION OF THE PREFERRED EMBODIMENTS

Figure 1:
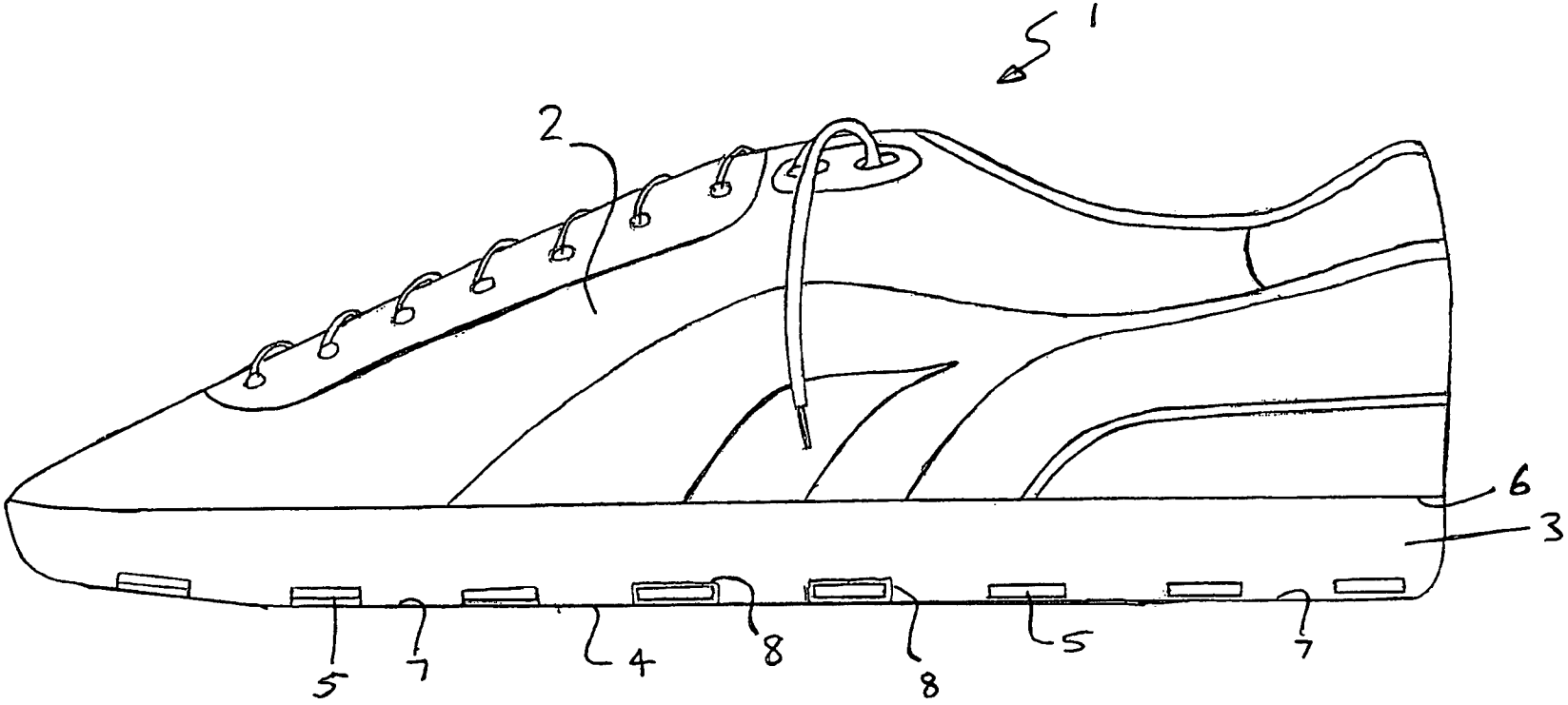
FIG. 1 is a side view of footwear of an embodiment of the present invention.

There is schematically depicted in the drawings, footwear 1 having a vamp 2, an insole (not shown), a midsole 3 and an outsole 4. A plurality of spaced apart magnets 5 located adjacent the outsole 4 so that in use the magnets 5 provide a gripping force between the footwear 1 and a metallic surface (not shown) upon which the footwear 1 is placed. Preferably, the magnets 5 are located in the midsole 3. The surface could for example be a metal roof however the invention should not be limited to this use only. The midsole 3 includes a first surface 6 adjacent the insole and a second surface 7 adjacent the outsole 4. A plurality of apertures 8 receive the magnets 5 and extend inwardly from the second surface 7.

In a preferred form, the magnets 5 are embedded in the midsole 3 in the apertures 8. The magnets 5 can be secured in the footwear 1 by any typical fastening means, such as, by use of an adhesive, moulding, snap-fit, interference fit, or the like.

Figure 2:
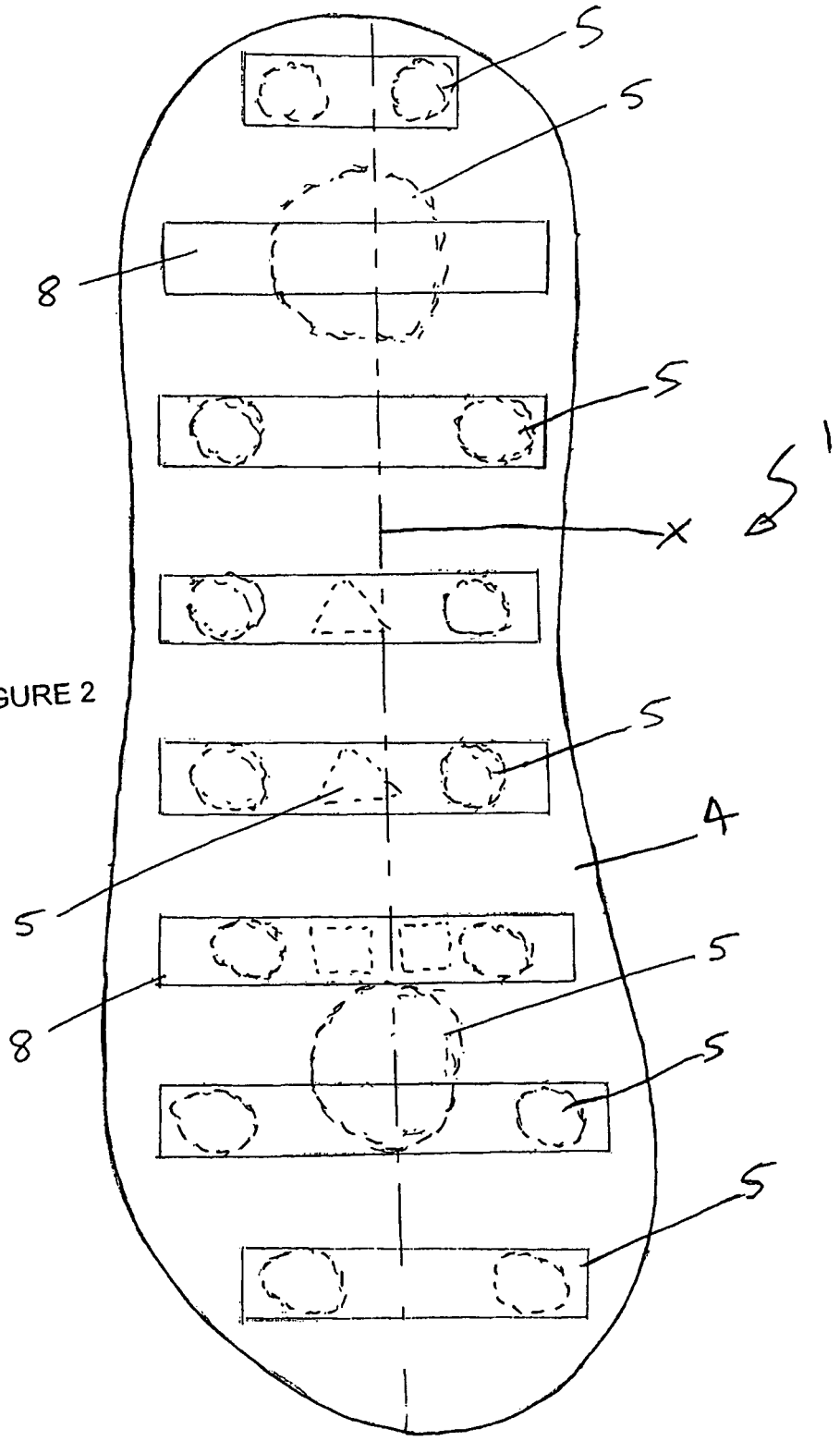
FIG. 2 is a bottom view of FIG. 1.

In a preferred form, the magnets 5 are located 2 to 10 mm from the second surface 7 and more preferably 2 to 4 mm from the second surface 7. The magnets 5 can be of any shape and in particular rectangular or circular. As best seen in FIG. 2, the magnets 5 are equally spaced, apart along a length X of the footwear 1. The magnets 5 can be aligned in a series of spaced rows along the longitudinal length X and can have a is distance between the rows of about 10 to 15 mm. However, it should be appreciated that the magnets 5 can be located in any pattern that provides suitable grippability.

The present invention at least in a preferred form provides footwear 1 having magnets 5 for use in particular in the construction industry and for use on metal rooves, scaffold or the like. However, it should be appreciated that footwear 1 could also be used on any metallic surface, such as, for skateboarding, bike riding, water skiing, trains, trucks, boats, containers, oil rigs, or the like. Footwear 1 will provide better traction for a user to a metal surface than existing footwear. Safety issues within the construction industry are very important and the footwear 1 is envisaged to provide further security for workers when working at heights and in particular on a roof. The footwear 1 could also be used for use on any such surface, for example, on aeroplane wings, trucks, stairs, containers or the like. The magnets 5 should be of sufficient strength to provide a gripping force to resist a user falling from an object or structure and could be tailored to a person's height or weight. The footwear 1 would be a sufficient advantage to a roof worker where the roof is pitched at a considerable angle and the roof material is metal. The footwear 1 could include a range of different size and strength magnets to allow more interchangeability depending upon the surface on which the user is working. It is also envisaged that the apertures 8 are arranged in such a way that the user can arrange the magnets 5 in a particular configuration to suit the work environment.

Although the invention has been described with reference to specific examples, it will be appreciated by those skilled in the art that the invention may be embodied in many other forms.

The invention claimed is:

1. Footwear comprising:

a vamp;

an insole;

a midsole having a first surface adjacent the insole, and an opposing second surface;

an outsole, wherein the second surface of the midsole is adjacent to the outsole; and a plurality of spaced apart magnets located adjacent said outsole so that in use said magnets provide a gripping force between said footwear and a metallic surface upon which said footwear is placed, wherein the plurality of spaced apart magnets are offset from the second surface in the direction of the first surface, and wherein the plurality of spaced apart magnets comprises at least a first and second magnet, wherein the first and second magnet are longitudinally aligned and equally offset from the second surface.

2. The Footwear of claim 1, wherein said magnets are embedded in said midsole.

3. The Footwear of claim 1, wherein said midsole includes a plurality of apertures to receive said magnets extending inwardly from said second surface towards said first surface.

4. The Footwear of claim 3, wherein said magnets are located 2 to 10 mm from the second surface.

5. The Footwear of claim 3, wherein said magnets are located 2 to 4 mm from the second surface.

6. The Footwear of claim 1, wherein said magnets are equally spaced apart along a longitudinal length of said footwear.

7. The Footwear of claim 1, wherein said magnets are aligned in a series of spaced apart rows along a longitudinal length of said footwear.

8. The Footwear of claim 7, wherein a distance between adjacent rows is 10 to 15 mm.

9. A footwear comprising:

a vamp;

an insole;

a midsole having a first surface adjacent the insole, and an opposing second surface; and an outsole, wherein the second surface of the midsole is adjacent to the outsole;

a plurality of apertures in the midsole extending from the outsole in the direction of the first surface of the midsole; and a plurality of spaced apart magnets positioned in the plurality of apertures between the first and second surfaces of the midsole so that the plurality of magnets are offset from the outsole, and wherein the plurality of spaced apart magnets comprises at least a first and second magnet, wherein the first and second magnet are spaced apart in a direction perpendicular to a longitudinal axis of the footwear, and wherein the first and second magnets are equally offset from the second surface.

10. A footwear comprising:

a vamp;

an insole;

a midsole having a first surface adjacent the insole, and an opposing second surface; and an outsole, wherein the second surface of the midsole is adjacent to the outsole;

a plurality of apertures in the midsole extending from the outsole in the direction of the first surface of the midsole; and a plurality of spaced apart permanent magnets positioned in the plurality of apertures between the first and second surfaces of the midsole so that the plurality of magnets are offset from the outsole, and wherein the plurality of spaced apart magnets comprises at least a first and second magnet, wherein the first and second magnet are longitudinally aligned and equally offset from the outsole.

* * * * *